United States Patent [19]

Mikulski et al.

[11] Patent Number: 4,703,148

[45] Date of Patent: Oct. 27, 1987

[54] PACKAGE FOR FROZEN FOODS FOR MICROWAVE HEATING

[75] Inventors: Barry S. Mikulski, Plymouth; Duane L. McDonald, Minneapolis; Lynn B. Deffenbaugh, Brooklyn Center, all of Minn.

[73] Assignee: General Mills, Inc., Minneapolis, Minn.

[21] Appl. No.: 919,946

[22] Filed: Oct. 17, 1986

[51] Int. Cl.[4] ..... H05B 6/80

[52] U.S. Cl. ..... 219/10.55 E; 219/10.55 F; 99/DIG. 14; 426/107; 426/243

[58] Field of Search ..... 291/10.55 E, 10.55 F; 99/DIG. 14, 451; 126/390; 426/241, 243, 234, 107

[56] References Cited

U.S. PATENT DOCUMENTS

| | | | |
|---|---|---|---|
| 4,122,234 | 10/1978 | Falk | 219/10.55 E |
| 4,190,757 | 2/1980 | Turpin et al. | 219/10.55 E |
| 4,204,105 | 5/1980 | Leveckis et al. | 219/10.55 E |
| 4,230,924 | 10/1980 | Brastad et al. | 219/10.55 E |
| 4,258,086 | 3/1981 | Beall | 219/10.43 |
| 4,267,420 | 5/1981 | Brastad | 219/10.55 F |
| 4,283,427 | 8/1981 | Winters et al. | 426/107 |
| 4,345,133 | 8/1982 | Cherney et al. | 426/107 |
| 4,425,368 | 1/1984 | Watkins | 426/107 |
| 4,555,605 | 11/1985 | Seiferth | 219/10.55 E |
| 4,590,349 | 5/1986 | Brown et al. | 219/10.55 E |
| 4,592,914 | 6/1986 | Kuchenbecker | 426/107 |
| 4,594,492 | 6/1986 | Maroszek | 219/10.55 E |
| 4,626,641 | 12/1986 | Brown | 219/10.55 E |

*Primary Examiner*—Philip H. Leung
*Attorney, Agent, or Firm*—John A. O'Toole

[57] ABSTRACT

Disclosed are packaged frozen food articles which are adapted to be heated by microwave. The articles include a frozen food item and a microwave heating package. The packages include a tray and an overwrapped paperboard carton having a microwave shield and having a plurality of windows in the sleeve. The package further includes an opposed pair of spaced parallel upper and lower microwave susceptor heating cards each comprising an inner heating layer mounted on a mounting board, and spacers for spacing the heating cards from the microwave shield such as a spaced pair of corrugated paperboard spacers intermediate the microwave shield and the heating cards. The heating layers are in direct contact with the food items and can comprise a metallized film. The microwave shield can be a foil such as aluminum foil.

19 Claims, 13 Drawing Figures

PACKAGE FOR FROZEN FOODS FOR MICROWAVE HEATING

THE TECHNICAL FIELD

The present invention relates to food products. More particularly, the present invention relates to packaged or wrapped foods adapted to preparation by microwave heating, especially for coated, fried fish portions. In its packaging aspect, the present invention resides in a package for food items adapted to microwave heating.

THE PRIOR ART

Par-fried frozen food items, especially fish, chicken and vegetables are popular food items. Upon conventional baking in an oven, the prepared food articles realized exhibit a relative evenness of temperature throughout and a crisp or crunchy coating. During oven heating both oil and water vapor are released and the exterior coating is toasted.

The heating of food articles with microwave energy by consumers has now become commonplace. Such microwave heating provides the advantages of speed and convenience. However, heating breaded food with microwaves often gives them a soggy texture and fails to impart the desirable browning flavor and/or crispness of conventionally oven heated products due in part to retention of oil and moisture. Unfortunately, if microwave heating is continued in an attempt to obtain a crisp exterior, the interior is generally overheated or overdone.

The prior art includes many attempts to overcome such disadvantages while attempting to retain the advantages of microwave heating. For example, in recent years, ceramic dishes that become hot in a microwave oven have been sold to solve the crisp/brown texture problem. Such a dish is quite heavy, relatively expensive and must be pre-warmed without food on it for about 2 to 5 minutes. A number of other containers that have been proposed for browning or searing the surface of a food fall into three general categories. The first are those which include an electrically resistive film usually about 0.00001 cm to 0.00002 cm thick applied to the surface of a nonconductor such as a ceramic dish and described, for example in U.S. Pat. Nos. 3,853,612; 3,705,054; 3,922,452 and 3,783,220. Heat is produced because of the $I^2R$ loss (resistive loss). While useful, such utensils are not suitable as disposable packages, due to their bulk weight, cost, breakability, etc.

The art also includes as a second category a variety of disposable packages which are adapted for the microwave heating and are successful in varying degrees in providing microwave heated articles with desired organoleptic attributes. Some articles, (see, for example, U.S. Pat. Nos. 4,190,757 and 4,283,427) while useful are both complex and costly and also are specially adapted to heat one type of food, e.g., pizza slices.

Other references are specifically directed toward the third category which includes the packaging for microwave heating of frozen, coated fish portions. U.S. Pat. Nos. 4,267,420 and 4,230,924 each disclose a food item comprising a fish stick wrapped with a plastic film having a thin metal coating or "metallized film." The metallized film is in direct contact with the major surfaces of the fish portion. Part of the microwave energy passes through to heat the food item dielectrically while part is converted to heat by the metallized film to sear the coating in contact therewith. A similar food item is disclosed in U.S. Pat. No. 4,258,086 which discloses an improved metallized film characterized by a protective cover layer over the metal coating and a grid pattern in the metal coating.

The present invention provides further improvements in the provision of packaged food articles adapted to be heated by microwave heating. Generally speaking, the present invention provides an improvement in the ratio of dielectric heating to sear or thermal heating so as to realize heated articles of improved organoleptic attributes. The improvements result from the addition of a spaced and configured microwave deflector. Also, the present invention is superior in allowing oil and water vapor to escape.

Provision of a microwave shield to a packaged article is well known. (See, for example, U.S. Pat. Nos. 4,345,133, 4,204,105 or 4,122,324.) However, while not wishing to be bound by the present theory, it is speculated herein that the present combination of critically spaced metal foil layers not only serves as a shield but also importantly to deflect and direct the microwave energy to the food being heated. Thus, while prior art package structures provide either shielding to protect a food piece side from overheating or a heating structure to heat a different side, the present invention provides packaging structures which provide both advantages for the same side, namely, intensive heating at the surface combined with shielding of the food piece's core.

DESCRIPTION OF THE PREFERRED EMBODIMENTS

Figure 1:
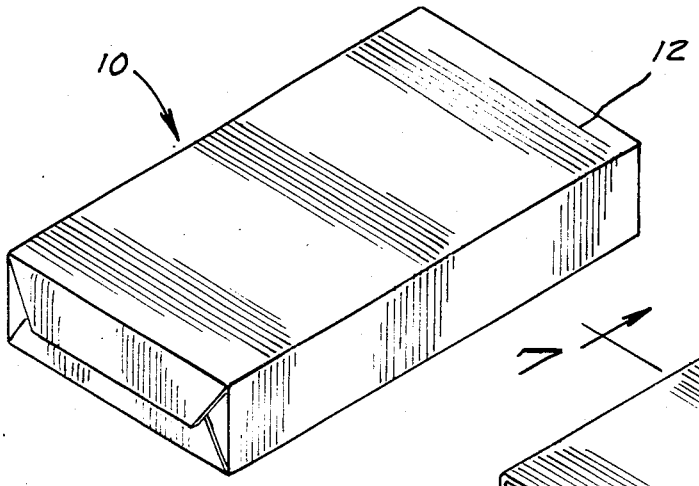
FIG. 1 is a perspective view of an embodiment of the present article of a wrapped and packaged food item.

Referring now to the drawings and in particular to FIG. 1, there is shown an embodiment of the present packaged food article designated generally by reference numeral 10. The article 10 can be of any conventional shape or size depending upon the size, number and shape of the food items being packaged such as the generally rectangular shape depicted. Of course, several articles 10 may be included into larger packs if desired. The article 10 preferably includes a conventional overwrap or wrapper 12 closely conforming to the shape of a carton described below and substantially surrounding and sealing the article. The material from which the overwrap 12 is fabricated can be any conventional packaging material for frozen foods such as a plastic film or heat oriented polyolefin copolymer having a thickness of about 0.0005 to 0.002 inch.

Figure 2:
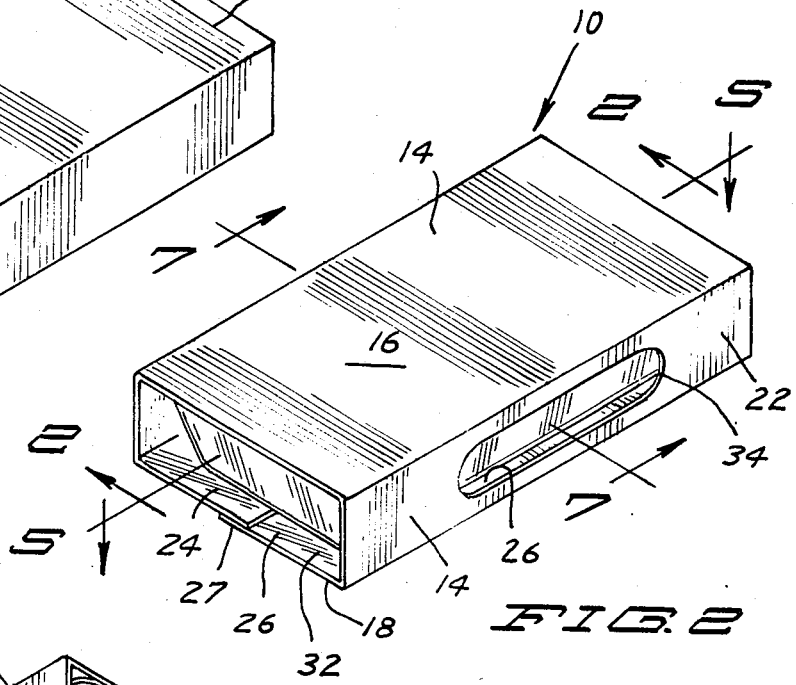
FIG. 2 is a perspective view of the article with the overwrapping removed and showing the top of the microwave shield sleeve of the packaged item housing a food tray.
Figure 3:
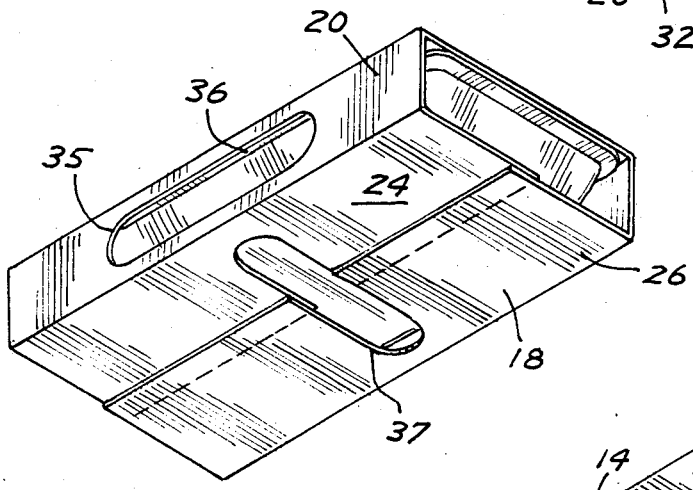
FIG. 3 is a perspective view of the article from another angle with the overwrapping removed and showing the bottom of the article.

In FIG. 2, the outer wrap has been removed as the consumer would normally do to reveal that the article 10 further includes an outer carton or sleeve 14 having an opposed pair of major or top 16 and bottom 18 surfaces. Bottom surface 18 is formed by the overlap by end pieces or flaps including an inner end flap 24 and an outer end flap 26. The outer carton 14 further includes an opposed pair of side surfaces 20 and 22 and opposed pair of end openings 28 and 29 (not shown). The carton 14 is importantly fabricated with first layer fabricated from a microwave transparent, or as sometimes referred to in the art as a "dielectric" material, such as thermoplastic or preferably paperboard because of its low cost. The carton 14 can be conveniently formed from a single folded sheet with any conventional food approved adhesive 27 bonding end flaps 24 and 26 together. Also, the carton is fabricated with a second layer or microwave shield 32 such as can be provided by a thin layer of metallic foil. The microwave shield covers the entire closed surface of the sleeve 14.

The microwave shield layer 56 is conventional in design and can be conveniently fabricated from a conductive metal foil such as aluminum, which although not critical, having a thickness of about 0.1 mils (8.9 microns) to 0.5 mils, preferably about 0.35 mils. The microwave shield is firmly adhered to the paperboard surface 32 using an adhesive such as a polyvinyl acetate in water emulsion. While having the shield 32 comprise the inner layer as depicted is preferred herein, the carton 14 can also be fabricated with the shield 32 as an external layer.

As can be seen from both FIG'S 2 and 3, the sleeve 14 is provided with a plurality of windows such as a first window or opening 34 in side 22, a second window 35 in side 20, and a third window 37 in bottom surface 18. Briefly, (and as further described below) the windows' function is to allow a controlled fraction of the microwave energy to pass through the microwave shield 32 so as to provide rapid heating to the interior of the food pieces characteristic of conventional microwave heating. The size and number of the windows is controlled such that about 10–40%, preferably about 22% to 25%, of the surface area of each side 20 and 22 is composed of a window(s) while about 10% to 40%, preferably about 8% to 9%, of the bottom surface 18 is in the form of a window(s). The windows 34, 35 and 37 allow microwave heating at the juncture between the fish pieces. While it is essential that the closed sides and bottom each have at least one window, it has been surprisingly discovered that it is not essential to have a window in the top sleeve surface 16.

Figure 4:
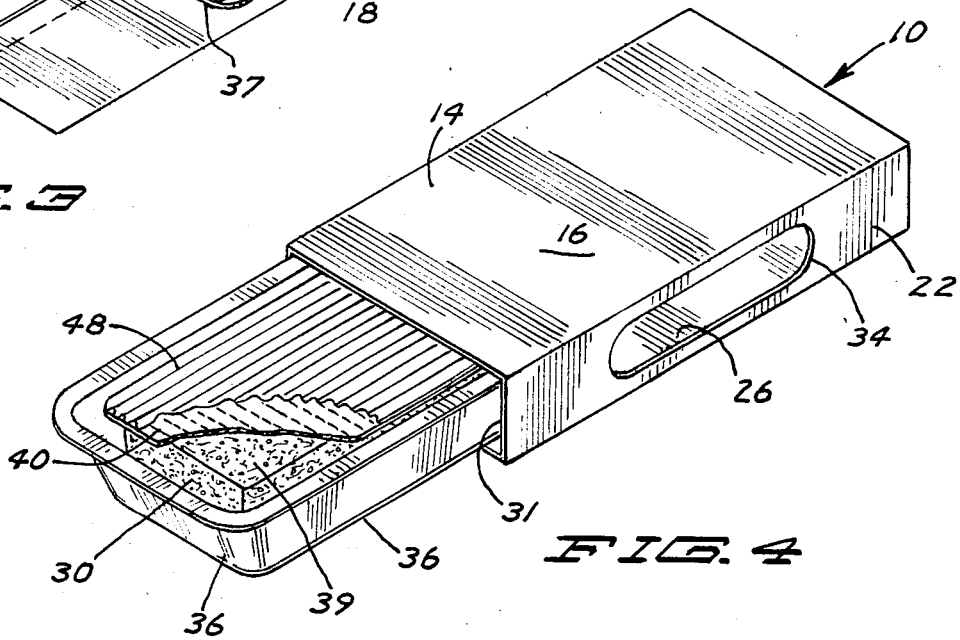
FIG. 4 is a perspective view of the article similar to that of FIG. 3 with the tray partially withdrawn from the microwave shield sleeve and with the susceptor and spacer partially cut away.

Referring now to FIG. 4, it can be seen that the article 10 further includes and the carton 14 houses in an interior cavity 31 a generally rectangular tray 36 containing one or more food items such as the food item pieces 30. The tray is readily insertable and retractable from the cavity 31 formed by the outer sleeve 14. The tray 36 is conventional in design and preferably is fabricated entirely from a dielectric material, i.e., a material substantially transparent to microwaves. Conveniently, the tray is inexpensively fabricated from pressed paperboard or other disposable material, e.g., polypropylene, crystallized polyester, filled nylon or filled polyesters and the like. Aluminum trays or trays having other aluminum or conductive parts are generally to be avoided inasmuch as their use can undesirably lead to arcing or excessive heating although very shallow aluminum trays can be employed even though less desired.

While the present invention is generally suitable for use in connection with a wide variety of par-fried, frozen items, the invention finds particular suitability in connection with frozen, par-fried coated fish or meat portions and while throughout the specification specific reference is made to pieces 30 to being fish portions is made, the skilled artisan will appreciate that the present invention can be used as well for such other frozen coated or uncoated food items including coated meats, especially chicken, or coated vegetables, e.g., egg plant. The present package also finds use in connection with pizza rolls, potatoes, e.g., hashbrown patties, sausages, corn dogs and the like. Also, while the pieces 30 are depicted as being generally of rectangular shapes, other shapes whether regular such as oval, wedge, log, circular, or irregular or combinations thereof, can also be employed. The pieces 30 nest closely to the sides of the tray 36 and may or may not be in contact therewith. The pieces 30 depicted each have an opposed pair of generally planar major surfaces such as upper surface 39 and lower surface 41 (not shown).

FIG. 4 shows that the present package further essentially includes an upper heating panel or susceptor 40 of a laminate construction described in detail below. The panel 40 lies over and is in direct physical contact with the food piece 30. The article also essentially includes an upper means for spacing the heating panel 40 from the microwave shield 32 such as a spacer member 48 mounted on top or over the heating panel 40. The spacer 48 may be solid, e.g., cellulosic foam or hollow (i.e., air filled) or a simple corrugated dielectric material, e.g., corrugated paperboard. In preferred embodiments, the spacer is fabricated from grease or oil resistant materials, e.g., glassine paper.

Figure 5:
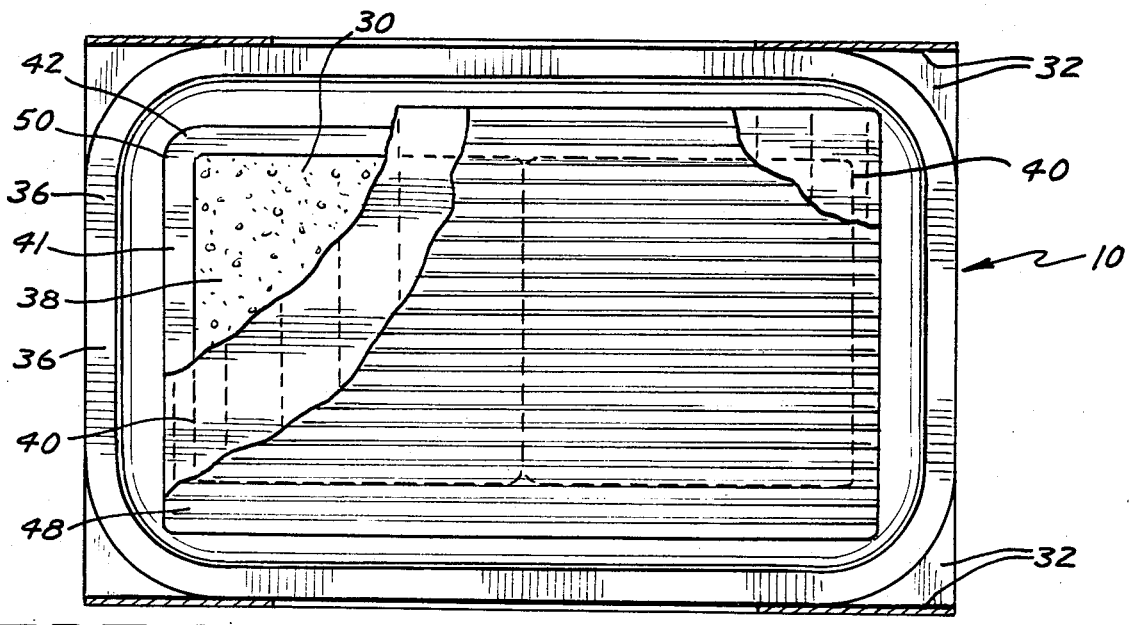
FIG. 5 an enlarged transverse sectional view of the packaged food item taken in the direction of lines 5—5 of FIG. 2.

Reference is now made to FIG. 5 which shows that the article 10 further essentially includes a second or lower heating panel 42 in spaced, opposed and parallel relationship to heating panel 40 and in direct physical contact with the bottom major surface 41 (not shown) of the food pieces 30. FIG. 5 further shows that heating panel 42 is provided with rounded edges 50 not only so as to fit better within tray 36 but also to minimize undesirable arcing which has been found to occur occasionally when the panel 42 is fabricated with square edges. Incidentally, FIG. 5 further shows that the food pieces 30 are positioned within the tray in side by side relationship on top of or mounted over the lower heating panel 42.

Reference is now briefly made to both FIG'S. 9 and 9A. The heating susceptor panels 40 and 42 as described above each contain a heating layer or resistive film 44, that is, the innermost layer of film 44, which is a film which heats upon exposure to microwave energy. The film is supported by a support layer or mounting board 46. The mounting board is composed of a dielectric material, e.g., paperboard, which is selected such that it can stand the temperatures reached by the heating layer 44 upon microwave heating, e.g., preferably up to about 450° F.

Figure 6:
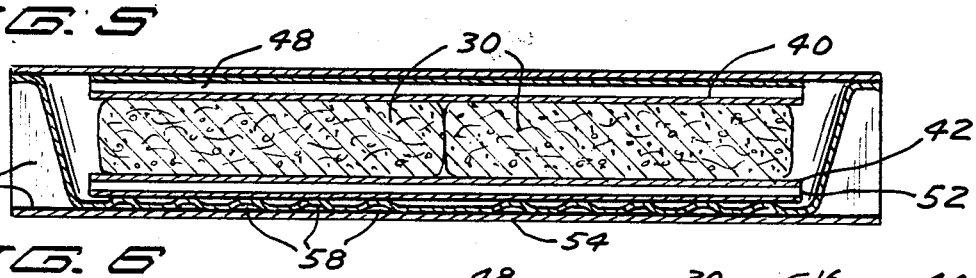
FIG. 6 is an enlarged transverse sectional view taken in the direction of lines 6—6 of FIG. 2.

Referring now to FIG. 6, it can be seen that the article 10 further includes a bottom means for spacing the lower heating panel 42 and the microwave shield 32 such as a bottom spacer member 52 similar in shape and composition to spacer 48 and positioned intermediate the bottom 54 of tray 36 and the lower panel 42. It can also be seen that the tray bottom can optionally be fabricated with a plurality of structural ribs or fluting 58 to give additional strength and rigidity to tray 36 as well as to provide drainage for oil released from the food pieces 30 upon heating. If desired, the tray can be fabricated with a thin coating or film (not shown) for superior moisture protection. The film composition can be selected from conventional food grade materials, e.g., polyethylene or polyester.

Figure 7:
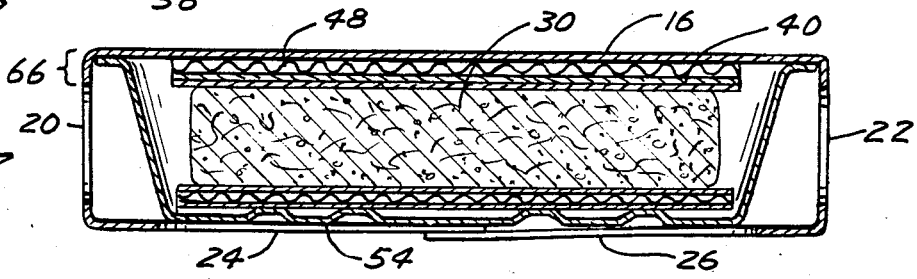
FIG. 7 is a more enlarged cross sectional view taken in the direction of lines 7—7 of FIG. 2.
Figure 8:
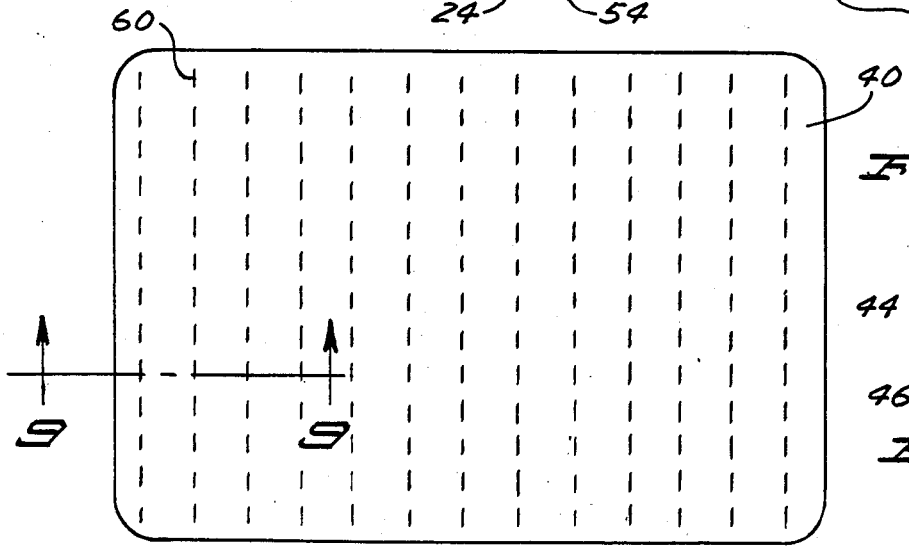
FIG. 8 is a plan view of a susceptor.
Figure 9A:
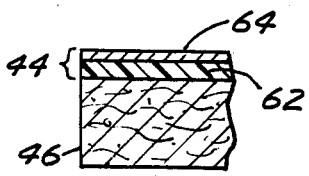
FIG. 9 and 9*a*are cross sectional views greatly enlarged of the susceptor taken along lines 9—9 of FIG. 8.
Figure 9:
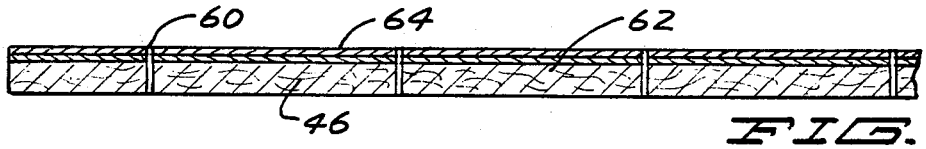

It can also be seen in FIG. 7 and as noted above that importantly the heating layers 44 of both upper and lower heating susceptor panels 40 and 42 are in direct physical contact with the food pieces 30. Such contact is maintained by the construction and sizing of the carton 14 to provide holding pressure in view of the size of the food pieces to be packaged and optionally spacers 48 and 52. Such intimate contact is important to the heating and crisping benefits provided by the present invention.

Reference is now made to FIG'S 8, 9 and 9A. Broadly, the construction of the heating panels 40 and 42 are known and have recently become commercially available from James River Inc. The heating panels 40 and 42 each contain a perforation feature 60 comprising a plurality of perforations therethrough which allows escape or release of any oil or moisture vapor which the food pieces release during heating. The perforations may be in the form of an organized array as depicted or may be randomly although preferably evenly distributed. The perforations allow oil and/or moisture released during microwave heating to be absorbed by the panel or drain therethrough and thus drawn away from the portions thereby further reducing the undesirable softening of the coating and oiliness of the final product as well as substantially reducing excessive oil buildup and heating on the heating panels and thus reduces both spattering and the generation of undesirable burned oil flavor. Also, the oil drainage is important since released oil in contact with the heating panel absorbs excessive amounts of the heat generated which in turn can result in uneven browning.

Preferred for use herein as the heating layer 44 are the metallized films described in U.S. Pat. No. 4,267,420 (issued May 12, 1981 to W. A. Brastad) or, less desirably, in U.S. Pat. No. 4,258,086 (issued Mar. 24, 1981 to N. J. Beall) each of which are incorporated herein by reference. These materials are widely known and a variety of suitable materials are available from, for example, the 3M Co., James River or from Deposition Technology Inc. (San Diego, CA). The heating layer 44 is preferably comprised of a first plastic sheet or thin film 62 which typically has a thickness of approximately 0.0005 to 0.001 inch. The plastic film 62 can be of polyester or other heat resistant polymers.

The heating layer 44 material further includes a very thin coating 64 on the plastic film, the coating 64 having a surface resistivity of, for example, approximately 1 to 300 ohms per square inch, and preferably about 1 to 10 ohms per square inch when aluminum is the applied metal. It will be understood that a resistivity of 1 ohm per square denotes a heavier or thicker coating than a coating of the same material having a 10 ohms per square resistivity. The greater the resistivity, the more microwave energy which is converted to heat. The practical upper limit to the resistivity is determined by the scorch temperature of the mounting board 46 and the plate separation as described below.

It will be appreciated that the specific resistance of a coating is susceptible to variation and that within limits the thicker such coating is the less pervious or more opaque it is to the passage of microwave energy therethrough. Hence, in order to promote a greater degree of browning, the coating 64 would be thicker than when a lesser degree of browning is desired. In this way, the browning or crisping can be correleted with the actual dielectric heating of the fish piece.

Admirably suited for the coating 64's composition would be aluminum which can be readily evaporated or sputtered onto the plastic film 62 by conventional methods. Obviously, other materials, such as tin oxide, chromium, nickel, magnesium, silver, copper and gold, or alloys with these metals as major constituents can be used. However, aluminum is inexpensive and has been widely used in the form of aluminum foil as far as the general packaging of food is concerned.

Owing to the thinness of the material constituting the coating 64, it has very little thermal mass. Thicknesses of only 0.5 to $20\times10^{-6}$ inch can be readily realized. Aluminum has the added capability of being readily deposited uniformly onto the plastic film in forming a satisfactory thin coating.

If desired, an additional protective sheet or film of plastic (not shown) can be laminated onto the coating 64, such as by adhesion. In this instance, the top protective film is preferably of polyester, having substantially the same thickness and properties as the polyester film 62.

Consequently, it will be recognized that the coated heating film 44 is not only very thin but quite flexible, as well. It should be recognized that the coating 64 is in close proximity with the surface of the fish portions 38 that are to be browned and crisped. In this way, the heat generated by the coating 64 is transmitted directly into the major surfaces 39 and 41 of the fish portions 30, imparting the desired browning and crisping thereto. Of course, when the package is subjected to microwave energy, only some of the microwave energy impinging on the package is converted into heat by the coating. The remainder of the microwave energy passes through the windows in side surfaces 20 and 22 and end openings 28 and 29 to heat the food pieces interior.

Other materials which are well known in the art can be used in substitution for one or both of the heating layers 44 such as those materials described in U.S. Pat. No. 4,190,757 (issued Feb. 26, 1980 to C. H. Turpin) and which is incorporated herein by reference wherein a heating body is described comprising a supporting sheet to which an active microwave absorber has been applied as a relatively thin paint-like layer. The absorber can be any of four groups of materials including semiconductors, selected ferromagnetic materials, period 8 oxides and selected dielectric materials.

Referring briefly back to FIG. 6, the combined thickness of the spacers and support layers together, between the heating layer 44 and microwave shield or the metal foil layer 32 define a plate separation 66 which importantly ranges from about 1 to 25.0, preferably about 2–15 mm. and for fish pieces most preferably about 6 cm., The greater the plate separation 66, the less shielding of the heating structure and therefore the more heat which is generated by the coating up to a limit. Clearly, insufficient plate separation can lead to insufficient heat generation in the heating layer 44 resulting in turn in inadequate browning/crisping of the coating and overheating of the fish portions interior. Excessive plate separation can also undesirably lead to scorching of the mounting board 46.

Still referring to FIG'S 8, 9 and 9A, the mounting board 46 is desirably fabricated from dielectric materials, i.e., microwave transparent, with paperboard being the material of choice due to cost and familiarity. The panels 40 and 42 are constructed simply by laminating or securely bonding one layer to another in appropriate sequence with adhesive means with the adhesive means (not shown) from layer to layer being either the same or different. Conventional food approved adhesives can be used. Although much less preferred, the panels can be merely juxtaposed instead of being laminated.

Figure 10:
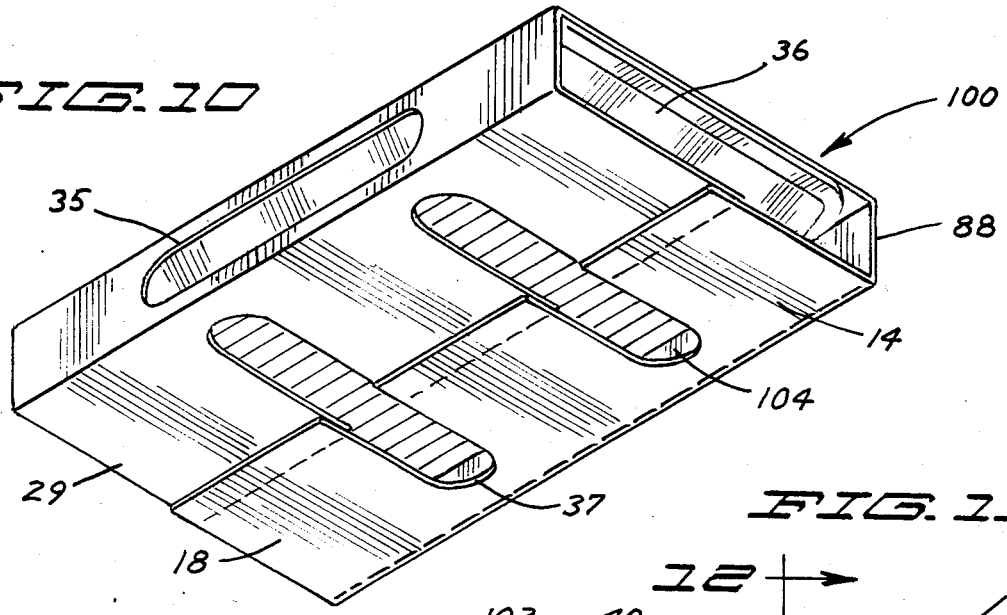
FIG. 10 is a perspective view of the bottom of another embodiment of the present article with the overwrap removed, similar to the view of FIG. 3.

Reference is made now to FIG. 10 which shows an embodiment of the present article 100 having a similar general construction to article 10 described above. In this figure, elements which are the same as elements in FIG.'S 1–9 bear like reference numerals. This embodiment is especially suitable for larger packages containing, for example, 12 pieces of fish sticks 102. FIG. 10 depicts that sleeve 14 of article 100 as having a second bottom window 104 in addition to first window 37. Preferably, the windows 37 and 104 are evenly spaced apart and from the open ends 28 and 29 so as allow microwave passage therethrough to heat the center portions of the fish stick pieces 102.

Figure 11:
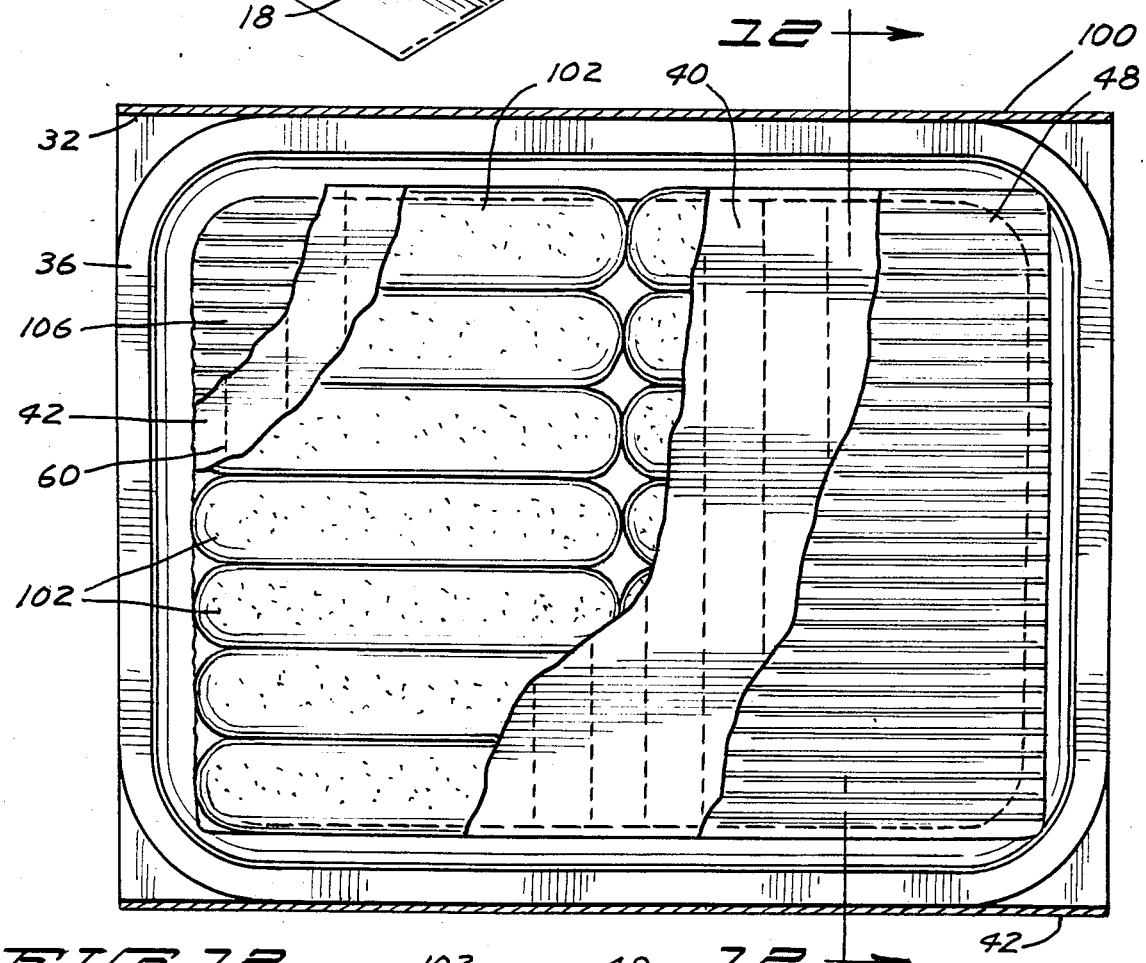
FIG. 11 is a plan view of the article with both overwrap and shielding removed depicting the composite elements with their several layers each partially cut away.

Referring now to FIG. 11, it can be seen that article 100 is substantially similar to article 10 and essentially comprises tray 36 holding fish sticks 102 which rest upon heating susceptor 42. Mounted over fish sticks 102 is the upper heating susceptor 40 over which lies top pacer 48.

Figure 12:
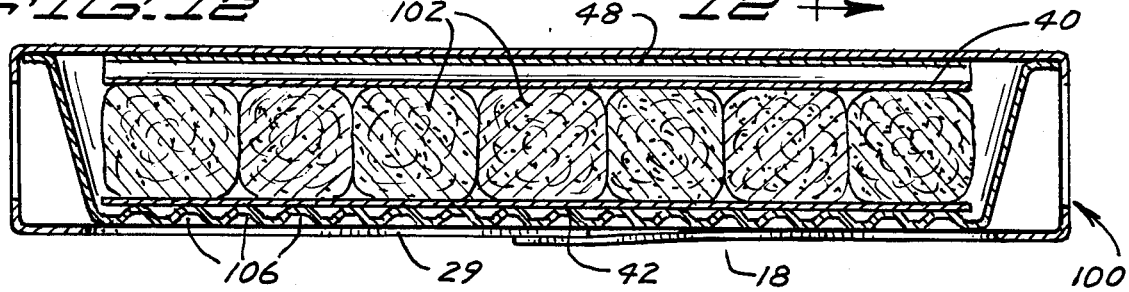
FIG. 12 is a cross sectional view taken in the direction of lines 12—12 of FIG. 11.

However, now referring to FIG. 12, it can be seen that article 100 comprises a lower means for spacing 106 heating susceptor 42 from the microwave shield 32 which comprises corrugated ribs or fluting 108 integrally formed as part of tray 36. The skilled artisan can thus appreciate that a variety of package constructions can be readily provided which accomplish the desired controlled plate separation. In addition to the spacer elements 48 and 52 of article 10 or the tray ribs 108 of article 100, the essential plate separation can be achieved in other embodiments without either of these additional elements by careful selection and rigidity of other package members and careful package fabrication and handling.

It should be understood that the foregoing description of the invention is intended merely to be illustrative thereof and that the invention is not confined to the construction and arrangements of parts herein illustrated and described, but embraces all such modified forms thereof as come within the scope of the following claims.

What is claimed is:

1. A package useful for packaging a frozen food to be heated and browned by microwave energy in a microwave oven, comprising:

an outer carton having a top closed major surface, a bottom closed major surface spaced apart and parallel to the top, a pair of spaced, parallel closed side elements, and a pair of spaced, opposed open sides defining an interior food cavity, said carton being fabricated from a dielectric material, wherein each of said major surfaces and closed side elements include a microwave shield layer, wherein each closed side element has a window and wherein the bottom closed major surface has a window;

a tray having a bottom positioned within said cavity for supporting the food;

a first browning means mounted in the bottom of said tray capable of converting microwave energy into heat for browning a lower surface of the food located within said cavity;

a first spacer positioned intermediate the first browning means and the bottom closed major surface said spacer having a thickness ranging from about 1 to 25.0 mm. thereby defining a first plate separation between the microwave shield and the first browning means ranging from about 1 to 25.0 mm.;

a second browning means capable of converting microwave energy into heat for browning an upper surface of the food positioned above and resting upon the food; and a second spacer positioned intermediate the second browning means and the top closed major surface said spacer having a thickness ranging from about 1 to 25 mm. thereby defining a second plate separation between the microwave shield and the second browning means ranging from about 1 to 25 mm.

2. The package of claim 1 wherein the first and second browning means each comprises:

1. a heating layer in sheet form having a dielectric substrate having a thin semiconducting coating thereon having the property of being able to convert a proportion of the microwave energy from the oven into heat in the coating itself;
2. a mounting board in sheet form having first and second major surfaces fabricated from a dielectric material upon which the heating layer is mounted on the first major surface.

3. The package of claim 2 wherein the microwave shield layer is a metal foil.

4. The package of claim 3 wherein the metal foil is aluminum, wherein the semiconducting coating has a specific surface resistance of from about 1 to 300 ohms per square inch.

5. The package of claim 4 wherein the coating is evaporated or sputtered aluminum, wherein each means for spacing comprises a corrugated dielectric material layer.

6. The package of claim 5 wherein each dielectric material is cardboard.

7. The package of claim 6 wherein each plate separation ranges from about 2 to 15 mm.

8. The package of claim 7 wherein each heating means includes a plurality of puncture holes through the heating layer and mounting board.

9. The package of claim 8 wherein the holes are in a regular array.

10. A packaged food item intended to be heated by microwave heating, comprising:

an outer carton having a top closed major surface, a bottom closed major surface spaced apart and parallel to the top, a pair of spaced, parallel closed side elements, and a pair of spaced, opposed open sides defining an interior food cavity, said carton being fabricated from a dielectric material, wherein each of said major surfaces and closed side elements include a microwave shield layer, wherein each closed side element has a window and wherein the bottom surface has a window;

a tray having a bottom positioned within said cavity for supporting the food;

a plurality of food pieces mounted in the tray;

a first lower browning means mounted in the bottom of said tray intermediate the tray and the food pieces capable of converting microwave energy into heat for browning a lower surface of the food pieces located within said tray;

a first spacer positioned intermediate the first browning means and the bottom closed major surface said spacer having a thickness ranging from about 1 to 25 mm. thereby defining a first plate separation between the microwave shield and the first browning means ranging from about 1 to 25 mm.;

a second upper browning means for converting microwave energy into heat for browning an upper surface of the food positioned above and resting upon the food; and a second spacer positioned intermediate the second browning means and the top closed major surface said spacer having a thickness ranging from about 1 to 25 mm. thereby defining a second plate separation between the microwave shield and the second browning means ranging from about 1 to 25 mm.

11. The packaged food item of claim 10 wherein the first and second browning means each comprises:

1. a heating layer in sheet form having a dielectric substrate having a thin semiconducting coating thereon having the property of being able to convert a proportion of the microwave energy from the oven into heat in the coating itself;
2. a mounting board in sheet form having first and second major surfaces fabricated from a dielectric material upon which the heating layer is mounted on the first major surface.

12. The packaged food item of claim 11 wherein the microwave shield layer is a metal foil.

13. The packaged food item of claim 12 wherein the metal foil is aluminum, wherein the semiconducting coating has a specific surface resistance of from about 1 to 300 ohms per square inch.

14. The packaged food item of claim 13 wherein the coating is evaporated or sputtered aluminum, wherein each means for spacing comprises a corrugated dielectric material layer.

15. The packaged food item of claim 14 wherein each dielectric material is cardboard.

16. The packaged food item of claim 15 wherein each plate separation ranges from about 2 to 15 mm.

17. The packaged food item of claim 16 wherein each heating means includes a plurality of puncture holes through the heating layer and mounting board.

18. The packaged food item of claim 17 wherein the holes are in a regular array.

19. The packaged food item of claim 18 wherein the food pieces are breaded, fried fish portions.

* * * * *